United States Patent [19]

Wilson

[11] 4,042,506

[45] Aug. 16, 1977

[54] APPARATUS FOR REMOVING SOLID MATERIAL FROM SEWAGE OR OTHER LIQUID

[75] Inventor: Reginald Albert Edward Wilson, Stourbridge, England

[73] Assignee: Jones & Attwood Limited, Stourbridge, England

[21] Appl. No.: 675,455

[22] Filed: Apr. 9, 1976

[30] Foreign Application Priority Data

Apr. 24, 1975 United Kingdom ..... 16979/75

[51] Int. Cl.[2] ..... B01D 33/06

[52] U.S. Cl. ..... 210/155; 210/158; 210/159; 210/161; 210/407

[58] Field of Search ..... 210/155, 156, 157, 158, 210/159, 161, 162, 415, 236, 407, 413

[56] References Cited

U.S. PATENT DOCUMENTS

| | | | |
|---|---|---|---|
| 414,887 | 11/1889 | Rakes et al. | 210/159 |
| 1,109,385 | 9/1914 | Allison | 210/155 |
| 1,709,291 | 4/1929 | Vidler | 210/155 |
| 2,106,851 | 2/1938 | Nordell | 210/155 X |
| 2,996,189 | 8/1961 | Salterbach | 210/236 |
| 3,230,865 | 1/1966 | Hibbel et al. | 210/415 X |
| 3,836,463 | 9/1974 | Teague et al. | 210/162 |

*Primary Examiner*—Thomas G. Wyse
*Assistant Examiner*—Robert H. Spitzer

[57] ABSTRACT

Apparatus for removing solid material from a flow of sewage or other liquid, the apparatus having a duct through which in use sewage will flow and two screens located in said duct adjacent to each other, one of said screens being arranged to receive solid material filtered from the sewage flow by the other screen and there being also provided a vertically reciprocable lifting plate which is adapted to collect solid material from said one screen and lift it to a position which is above the upper surface of the flow of sewage.

7 Claims, 3 Drawing Figures

APPARATUS FOR REMOVING SOLID MATERIAL FROM SEWAGE OR OTHER LIQUID

This invention relates to apparatus for removing solid material from a flow of sewage or other liquid, the object of the invention being to provide such apparatus in an improved form.

In accordance with the invention, there is provided apparatus for removing solid material from a flow of sewage or other liquid, said apparatus comprising a duct through which sewage is to flow, a first screen located in said duct and adapted to filter solid material from the sewage flowing through the duct, a second, vertically extending, screen located adjacent to said first screen and adapted to receive solid material filtered from the sewage flow by the first screen, and a lifting plate which is reciprocable in a vertical or substantially vertical direction over said second screen so as to collect solid material therefrom and lift it to a position which in use is above the upper surface of the flow of sewage.

There is also preferably provided a generally horizontally extending compression chamber having means for removing solid material from the lifting plate when the latter is in its upper position. The first screen is of generally cylindrical form arranged so that its axis extends in a vertical direction and is rotatable about its axis either in a constant angular direction of rotation or alternately in the two opposite angular directions of rotation.

Figure 1:
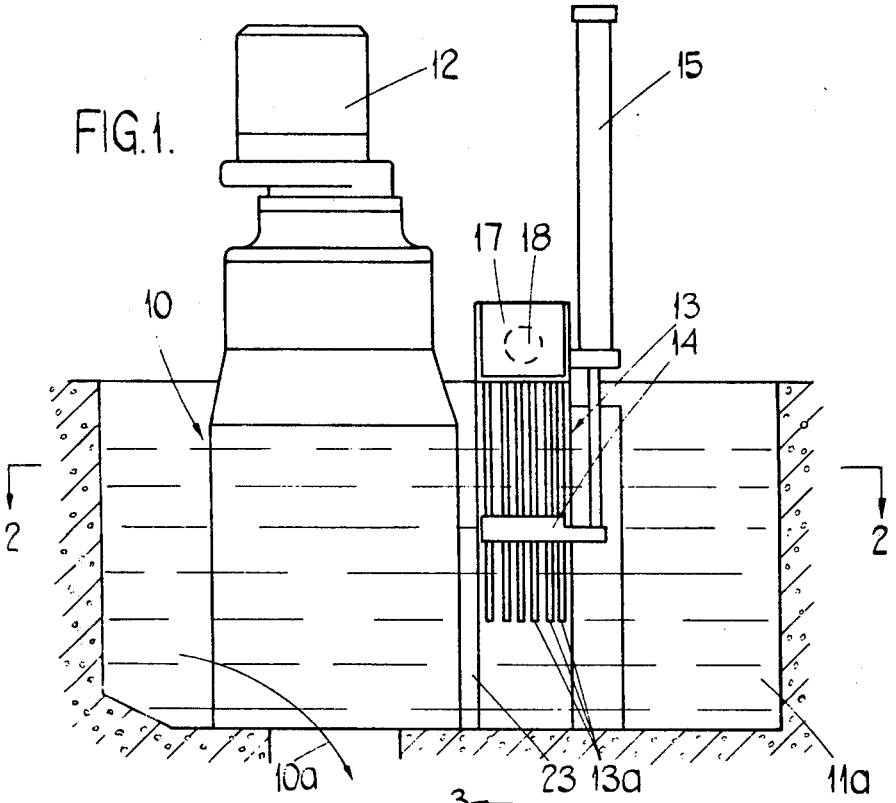
Figure 2:
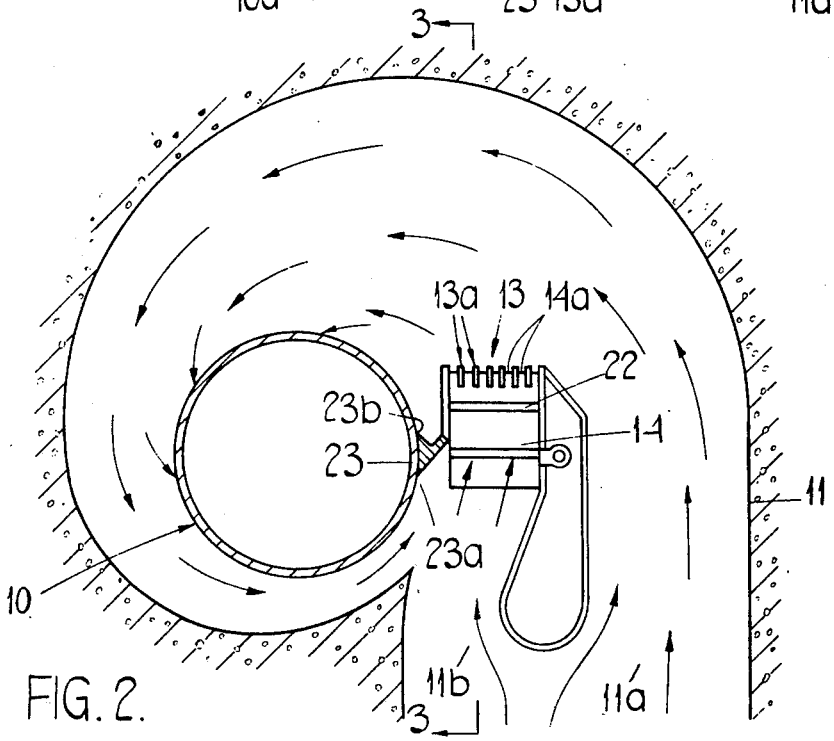
Figure 3:
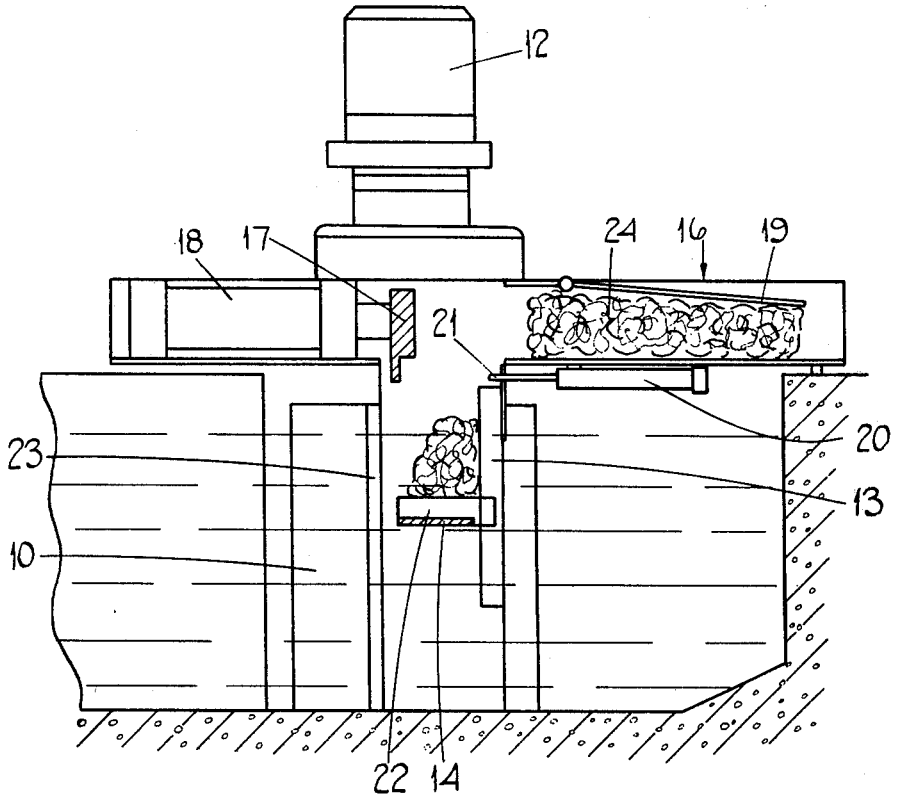

The invention will now be more particularly described with reference to the accompanying drawing wherein FIG. 1 is a sectional elevation of one example of apparatus constructed in accordance with the invention, FIG. 2 is a sectional plan view taken on the line 2—2 of FIG. 1 and FIG. 3 is a sectional elevation taken on the line 3—3 of FIG. 2.

In the example shown in the drawings there is provided a first screen 10 which is located in a duct 11 intended in use to receive a flow of liquid such as for example sewage. Said first screen 10 is of generally cylindrical configuration arranged so that its axis extends in a vertical or generally vertical direction, the screen being formed in any convenient way with slots or apertures (not shown) through which liquid can flow. The duct 11 is arranged so that it includes an inlet channel 11*a* which is generally tengential to said first screen and the arrangement is such that liquid flowing through said inlet channel 11*a* can pass through said first screen 10 into the interior thereof (as indicated by arrow 10*a*) whereas any solid material in the flow of sewage entering said inlet channel will be trapped on the exterior of said first screen and thus filtered from the sewage. The first screen is arranged to be rotatable about its axis for which purpose it is connected to an electric motor 12.

There is also provided a second screen 13 which comprises a plurality of vertically extending bars 13*a*, said second screen being disposed adjacent to the exterior of the first screen 10, the second screen being located on that side of the first screen adjacent to said inlet channel 11*a*. Furthermore the second screen, which is fixed, is arranged so that the upper ends of said bars extend in use to a position above the level of the upper surface of the flow of sewage through the apparatus. The duct 11 also includes a further channel 11*b* which is branched from the channel 11*a* so as to divert a part of the sewage flow into the apparatus and to provide a direct flow on to the screen 13.

Associated with said second screen 13 is a lifting plate 14 which is reciprocable as by means of a fluid pressure operated piston and cylinder unit 15 in a generally vertical direction, upward movement of said lifting plate being arranged to collect any solid material which has been trappedagainst the adjacent side of said second screen 13. If desired vertically extending guides may be provided for guiding the vertical movement of the lifting plate 14. Furthermore at the upper end of said second screen there is provided a compression chamber generally indicated by reference number 16 having means for removing solid material from the lifting plate 14 when the latter is in its upper position. Thus, said means includes a pressure head 17 mounted at one end of the chamber and connected to a further fluid-pressure actuated piston and cylinder unit 18. The opposite end of said chamber 16 tapers in a direction away from the pressure head 17 and is bounded in part by a hinged plate 19 which is loaded by a spring (not shown) which tends to urge the outer free end of said plate in a downward direction. Said plate and/or the walls of the compression chamber in this region and the pressure head itself may also be provided with drainage apertures.

Beneath said compression chamber 16 there is provided a third fluid-pressure actuated piston and cylinder unit 20 the piston rod of which is connected to horizontally extending spaced prongs or forks of which one fork 21 is seen in FIG. 1. These forks 21 are adapted to enter into grooves or channels 22 formed in the upper surface of the lifting plate 14 when the latter is in its uppermost position.

Associated with the first, cylindrical screen 10 is scraper means in the form of a single scraper bar 23 having two opposed scraper edges 23*a* and 23*b*. Moreover said first screen is alternately rotatable by said motor 12 in the two opposite angular directions of rotation. This is achieved by providing a cam operated timing device together with limit switch means (not shown but of conventional form) which are adapted to synchronize the alternate rotations of said screen 10 and the vertical movements of the lifting plate 14 over the second screen 13. Thus when the cam operated timing device provides a signal to operate said piston and cylinder unit 15 to lift the lifting plate 14 over the second screen 13 a switch is also operated to stop rotation of the screen 10 in, for example, an anti-clockwise direction. After the plate 14 has reached its upper position, having collected solid material from the face of the second screen 13, said cam operated timing device initiates rotation of the screen 10 but in a clockwise direction and the unit 20 is actuated to insert the forks 21 into the grooves 22 of the plate 14 so as to support solid material carried up by said plate whilst the plate itself descends again by appropriate actuation of the unit 15. At the same time the unit 18 is actuated so that the pressure head 17 will push material (indicated by reference 24) off the forks to the right as seen in FIG. 1. With repeated cycles of operation, such materials will gradually pass beneath the plate 19 (being de-watered and compressed as it does so) and may then be removed from the right-hand end of the pressure chamber. Continued actuation of the cam timing device then starts the original or anti-clockwise rotation of the first screen just after the lifting plate reaches its bottom position and this rotation continues until the next cycle is started. The cam operated timing device is arranged to effect actuation of unit 18 to return the pressure head 17 to its original position and to effect actuation of unit 20 to withdraw the forks 21 prior to the next ascent of lifting plate 14.

One of the aforementioned scraper bar edges 23*a* will thus arrest any solid material which is collected on the exterior of the first screen 10 during its initial or anticlockwise rotation. Such solid material will be carried onto the second or vertically extending bar screen 13. This second screen is then cleaned as above described by the lifting plate 14 which conveniently is provided with forks 14*a* which protrude between the bars 13*a* of said second screen. Reversal of said first screen 10 as aforesaid will clear any solid material trapped on the aforementioned scraper bar edge 23*a* the second scraper bar edge 23*b* then acting to arrest solid material carried round by the screen 10 during its reverse rotation. As the lifting plate 14 descends any solid material which has then collected on the bars 13*a* of the second screen is pushed downwardly by the lifing plate and can pass beneath said second screen the lower ends of which are spaced somewhat above the bottom of the inlet channel 11*b.* Such solid material can then pass beneath the screen 10 and round the first screen 10 again until eventually it will be lifted by the lifting plate 14 and removed as above described. Whilst the lifting plate is in its lower position however it, together with short spaced bars which project upwardly from the plate in the plane of the screen 13, will fill the gap between the lower end of said second screen and the bottom of the inlet channel 11*b* so that solid material cannot then pass beneath the second screen.

The above described apparatus thus provides a very convenient and effective method of continuously cleaning a screen which is rotatable intermittently in two opposite directions of rotation. The invention can however also be applied to the cleaning of a fixed screen or to a screen which is rotated continuously in one direction and of course the invention can be applied to the filtering of solid-containing liquid other than sewage.

I claim:

1. Apparatus for removing solid material from a flow of sewage or other liquid, said apparatus comprising a duct through which sewage is to flow, a first screen located in said duct and adapted to filter solid material from the sewage flowing through the duct, said first screen being of generally cylindrical form with its axis extending in a vertical direction and being rotatable about said axis, a second, vertically extending, screen located adjacent to said first screen and adapted to receive solid material filtered from the sewage flow by the first screen, a lifting plate reciprocable in a vertical or substantially vertical direction over said second screen, said lifting plate collecting solid material from said second screen and lifting it to a position which in use is above the upper surface of the flow of sewage, and a generally horizontally extending compression chamber having means for removing solid material from said lifting plate when the latter is in its upper position.

2. Apparatus as claimed in claim 1 wherein there is provided adjacent to said second screen scraper means adapted to remove from said first screen solid material collected thereby.

3. Apparatus as claimed in claim 2 including means for alternately rotating said first screen in opposite angular directions and wherein said scraper means is provided with two opposed edges which are arranged respectively to remove solid material from said first screen whilst the latter is rotated in said opposite angular directions of rotation.

4. Apparatus as claimed in claim 3 wherein said scraper means comprises a single bar.

5. Apparatus as claimed in claim 1 wherein said lifting plate is reciprocable by a fluid-pressure actuated piston and cylinder unit.

6. Apparatus as claimed in claim 2 wherein said duct is shaped to provide a pair of channels, one of said channels being arranged to lead sewage or other liquid on to said first screen and the other channel being arranged to divert a part of the flow of said sewage or other liquid to cause said part to flow directly on to said second screen.

7. Apparatus as claimed in claim 1 wherein said compression chamber is provided with a pressure head which is reciprocable within said chamber by a fluid-pressure actuated piston and cylinder unit.

* * * * *